US006017873A

United States Patent [19]

Sikra et al.

[11] Patent Number: 6,017,873

[45] Date of Patent: Jan. 25, 2000

[54] PROCESSES FOR MAKING AGGLOMERATED HIGH DENSITY DETERGENT COMPOSITION CONTAINING SECONDARY ALKYL SULFATE SURFACTANT

[75] Inventors: Stephen William Sikra, Erlanger, Ky.; James Bert Royston, St. Bernard, Ohio

[73] Assignee: The Procter & Gamble Compnay, Cincinnati, Ohio

[21] Appl. No.: 09/142,456

[22] PCT Filed: Feb. 26, 1997

[86] PCT No.: PCT/US97/04690

§ 371 Date: Feb. 24, 1999

§ 102(e) Date: Feb. 24, 1999

[87] PCT Pub. No.: WO97/32954

PCT Pub. Date: Sep. 12, 1997

Related U.S. Application Data

[60] Provisional application No. 60/013,137, Mar. 8, 1996.

[51] Int. Cl.[7] ..... C11D 11/00

[52] U.S. Cl. ..... 510/444; 510/352; 510/356; 510/361; 510/441; 510/498; 510/507; 510/509; 510/511; 510/512; 264/117; 264/140

[58] Field of Search ..... 510/444, 352, 510/356, 361, 441, 498, 507, 509, 511, 512; 264/117, 140

[56] References Cited

U.S. PATENT DOCUMENTS

| | | | |
|---|---|---|---|
| 5,164,108 | 11/1992 | Appel et al. | 510/444 |
| 5,478,500 | 12/1995 | Swift et al. | 510/350 |
| 5,478,502 | 12/1995 | Swift | 510/350 |
| 5,478,503 | 12/1995 | Swift | 510/350 |
| 5,489,392 | 2/1996 | Capeci et al. | 510/441 |
| 5,565,420 | 10/1996 | Stearns | 510/358 |
| 5,576,285 | 11/1996 | France et al. | 510/444 |

FOREIGN PATENT DOCUMENTS

| | | |
|---|---|---|
| 2289687 | 11/1995 | United Kingdom . |
| 94/24241 | 10/1994 | WIPO . |
| 94/24242 | 10/1994 | WIPO . |
| 95/14072 | 5/1995 | WIPO . |
| 95/33031 | 12/1995 | WIPO . |

*Primary Examiner*—Lorna M. Douyon
*Attorney, Agent, or Firm*—Kim W. Zerby; Brian M. Bolam; Ian S. Robinson

[57] ABSTRACT

Two processes for producing agglomerated high density detergent compositions are provided. On process comprises blending secondary (2,3) alkyl sulfate with a detergency builder to form a homogeneous powder mixture which is agglomerated with a surfactant paste mixture comprising $C_{10-20}$ linear alkylbenzene sulfonates, $C_{10-20}$ alkyl sulfates, $C_{10-18}$ alkyl ethoxy sulfates having from about 1 to about 7 ethoxy groups, alcohol ethoxylates and polyethylene glycol and drying the agglomerates. Another process comprises blending secondary (2,3) alkyl sulfate with a detergency builder to form a homogeneous powder mixture which is agglomerated with a liquid acid precursor of $C_{10-20}$ linear alkylbenzene sulfonate so as to form an agglomerated detergent composition which has a density of at least about 650 g/l.

10 Claims, No Drawings

PROCESSES FOR MAKING AGGLOMERATED HIGH DENSITY DETERGENT COMPOSITION CONTAINING SECONDARY ALKYL SULFATE SURFACTANT

This application claims the benefit of U.S. Provisional Application Ser. No. 60/013,137, filed Mar. 8, 1996.

FIELD OF THE INVENTION

Secondary alkyl sulfate (SAS) surfactants are processed using various ingredients to provide improved water solubility. The resulting SAS particles are useful in laundry detergents and other cleaning compositions, especially under cold water washing conditions.

BACKGROUND OF THE INVENTION

Most conventional detergent compositions contain mixtures of various detersive surfactants in order to remove a wide variety of soils and stains from surfaces. For example, various anionic surfactants, especially the alkyl benzene sulfonates, are useful for removing particulate soils, and various nonionic surfactants, such as the alkyl ethoxylates and alkylphenol ethoxylates, are useful for removing greasy soils. While a review of the literature would seem to suggest that a wide selection of surfactants is available to the detergent manufacturer, the reality is that many such materials are specialty chemicals which are not suitable for routine use in low unit cost items such as home laundering compositions. The fact remains that many home-use laundry detergents still comprise one or more of the conventional alkyl benzene sulfonate or primary alkyl sulfate surfactants.

One class of surfactants which has found limited use in various compositions where emulsification is desired comprises the secondary alkyl sulfates. The conventional secondary alkyl sulfates are available as generally pasty, random mixtures of sulfated linear and/or partially branched alkanes. Such materials have not come into widespread use in laundry detergents, since they offer no particular advantages over the alkyl benzene sulfonates.

Modern granular laundry detergents are being formulated in "condensed" form which offers substantial advantages, both to the consumer and to the manufacturer. For the consumer, the smaller package size attendant with condensed products provides ease-of-handling and storage. For the manufacturer, unit storage costs, shipping costs and packaging costs are lowered.

The manufacture of acceptable condensed granular detergents is not without its difficulties. In a typical condensed formulation, the so-called "inert" ingredients such as sodium sulfate are mainly deleted. However, such ingredients do play a role in enhancing the solubility of conventional spray-dried detergent: hence, the condensed form will often suffer from solubility problems. Moreover, conventional low-density detergent granules are usually prepared by spray-drying processes which result in porous detergent particles that are quite amenable to being solubilized in aqueous laundry liquors. By contrast, condensed formulations will typically comprise substantially less porous, high density detergent particles which are less amenable to solubilization. Overall, since the condensed form of granular detergents typically comprises particles which contain high levels of detersive ingredients with little room for solubilizing agents, and since such particles are intentionally manufactured at high bulk densities, the net result can be a substantial problem with regard to in-use solubility.

It has now been discovered that a particular sub-set of the class of secondary alkyl sulfates, referred to herein as secondary (2,3) alkyl sulfates (SAS), offers considerable advantages to the formulator and user of detergent compositions. For example, the secondary (2,3) alkyl sulfates are available as dry, particulate solids. Accordingly, they prospectively can be formulated as high-surfactant (i.e., "high-active") particles for use in granular laundry detergents. Since, with proper care in manufacturing, the secondary (2,3) alkyl sulfates are available in solid, particulate form, they can be dry-mixed into granular detergent compositions without the need for passage through spray drying towers. In addition to the foregoing advantages seen for the secondary (2,3) alkyl sulfates, it has now been determined that they are both aerobically and anaerobically degradable, which assists in their disposal in the environment. Desirably, the secondary (2,3) alkyl sulfates are quite compatible with detersive enzymes, especially in the presence of calcium ions.

The present invention converts SAS powder which has a relatively slow dissolution rate into fast-dissolving detergent agglomerates. Importantly, the SAS agglomerates provided herein are free-flowing, and can be readily admixed with other ingredients to provide fully-formulated granular detergents. Accordingly, the present invention overcomes many of the problems associated with the use of SAS in granular laundry detergents or other granular cleaning compositions.

BACKGROUND ART

Detergent compositions with various "secondary" and branched alkyl sulfates are disclosed in various patents; see: U.S. Pat. No. 2,900,346, Fowkes et al, Aug. 18, 1959; U.S. Pat. No. 3,234,258, Morris, Feb. 8, 1966; U.S. Pat. No. 3,468,805, Grifo et al, Sep. 23, 1969; U.S. Pat. No. 3,480,556, DeWitt et al, Nov. 25, 1969; U.S. Pat. No. 3,681,424, Bloch et al, Aug. 1, 1972; U.S. Pat. No. 4,052,342, Fernley et al, Oct. 4, 1977; U.S. Pat. No. 4,079,020, Mills et al, Mar. 14, 1978; U.S. Pat. No. 4,226,797, Bakker et al., Oct. 7, 1980; U.S. Pat. No. 4,235,752, Rossall et al, Nov. 25, 1980; U.S. Pat. No. 4,317,938, Lutz, Mar. 2, 1982; U.S. Pat. No. 4,529,541, Wilms et al, Jul. 16, 1985; U.S. Pat. No. 4,614,612, Reilly et al, Sep. 30, 1986; U.S. Pat. No. 4,880,569, Leng et al, Nov. 14, 1989; U.S. Pat. No. 5,075,041, Lutz, Dec. 24, 1991; U.S. Pat. No. 5,349,101, Lutz et al., Sep. 20, 1994; U.S. Pat. No. 5,389,277, Prieto, Feb. 14, 1995; U.K. 818,367, Bataafsche Petroleum, Aug. 12, 1959; U.K. 858,500, Shell, Jan. 11, 1961; U.K. 965,435, Shell, Jul. 29, 1964; U.K. 1,538,747, Shell, Jan. 24, 1979; U.K. 1,546,127, Shell, May 16, 1979; U.K. 1,550,001, Shell, Aug. 8, 1979; U.K. 1,585,030, Shell, Feb. 18, 1981; GB 2,179,054A, Leng et al, Feb. 25, 1987 (referring to GB 2,155,031). U.S. Pat. No. 3,234,258, Morris, Feb. 8, 1966, relates to the sulfation of alpha olefins using $H_2SO_4$, an olefin reactant and a low boiling, nonionic, organic crystallization medium.

Various means and apparatus suitable for preparing high-density granules have been disclosed in the literature and some have been used in the detergency art. See, for example: U.S. Pat. No. 5,133,924; EP-A-367,339; EP-A-390,251; EP-A-340,013; EP-A-327,963; EP-A-337,330; EP-B-229,671; EP-B2-191,396; JP-A-6,106,990; EP-A-342,043; GB-B-2,221,695; EP-B-240,356; EP-B-242,138; EP-A-242,141; U.S. Pat. No. 4,846,409; EP-A420,317; U.S. Pat. No. 2,306,698; EP-A-264,049; U.S. Pat. No. 4,238,199; DE 4,021,476.

See also: WO 94/24238; WO 94/24239; WO 94/24240; WO 94/24241; WO 94/24242; WO 94/24243; WO 94/24244; WO 94/24245; WO 94/24246; U.S. Pat. No.

5,478,500, Swift et al, Dec. 26, 1995; U.S. Pat. No. 5,478,502, Swift, Dec. 26, 1995; U.S. Pat. No. 5,478,503, Dec. 26, 1995.

SUMMARY OF THE INVENTION

The present invention meets the needs identified above by providing an agglomerated high density detergent composition containing secondary (2,3) alkyl sulfate surfactant. Two processes for producing the agglomerated high density detergent composition are also presented herein. The agglomerated detergent composition is substantially free of phosphates, has a density of at least 650 g/l and comprises a detersive surfactant system and a builder. The detersive surfactant system comprises linear alkylbenzene sulfates, alkyl sulfates, alkyl ethoxy sulfates and secondary (2,3) alkyl sulfates and demonstrates improved solubility in an aqueous laundering system.

As used herein, the term "agglomerates" refers to particles formed by agglomerating or "building-up" detergent granules or particles which typically have a smaller median particle size than the formed agglomerates.

As used herein, the phrase "median particle size" means the particle size at which 50% of the particles are smaller and 50% are larger in size and refers to individual agglomerates and not individual particles or detergent granules.

All percentages, ratios and proportions used herein are by weight, unless otherwise specified. All viscosities described herein are measured at 70° C. and at shear rates between about 10 to 50 $sec^{-1}$, preferably at 25 $sec^{-1}$. All documents including patents and publications cited herein, are incorporated by reference.

In accordance with one aspect of the invention, an agglomerated detergent composition having a density of at least 650 g/l is provided herein. The agglomerated detergent comprises from about 1% to about 70% by weight of a detersive surfactant system comprising $C_{10-20}$ linear alkylbenzene sulfonates, $C_{10-20}$ alkyl sulfates, $C_{10-18}$ alkyl ethoxy sulfates having from about 1 to about 7 ethoxy groups and $C_{10-20}$ secondary (2,3) alkyl sulfates. Additionally, the agglomerated detergent composition contains at least about 1% by weight of a detergency builder. The surfactant system and the detergency builder are agglomerated to form detergent agglomerates which have improved solubility in an aqueous laundering solution.

In accordance with another preferred aspect of the invention, a granular detergent composition comprises conventional formulation ingredients and at least about 10% to about 65%, by weight, of the agglomerated detergent composition.

In another preferred composition embodiment of the invention an agglomerated detergent composition having a density of at least 650 g/l comprises from about 5% to about 30%, more preferably from about 10% to about 25%, and even more preferably from about 15% to about 22% $C_{12-14}$ alkylbenzene sulfonate. The agglomerated detergent composition can optionally also comprise about 15% to about 35%, more preferably from about 22% to about 24% and even more preferably from about 21% to about 22% $C_{14-15}$ alkyl sulfate. In addition, the agglomerated detergent composition preferably includes from about 15% to about 35%, more preferably from about 10% to about 25% and most preferably from about 5% to 15% $C_{10-20}$ secondary alkyl (2,3) sulfate. Further, the agglomerated detergent composition contains from about 15% to about 35%, more preferably from about 10% to about 25% and most preferably from about 5% to about 15% aluminosilicate. Also included in agglomerated detergent composition is from about from about 10% to about 40%, preferably from about 5% to about 30% and most preferably from about 5% to about 25% sodium carbonate. The balance of the agglomerated detergent composition is made up of water and optionally other unreacting minor ingredients.

In a process aspect of the invention, referred to herein as the "paste" process, a process for making an agglomerated detergent composition comprising blending, mixing, and drying steps is provided. The first step of the paste method comprises blending secondary (2,3) alkyl sulfate with detergency builder to form a homogeneous powder mixture. The detergency builder is preferably a member from the group consisting of carbonate, aluminosilicate and zeolite. The homogeneous powder mixture is then combined with a surfactant paste mixture which includes from about 1% to about 80% by weight of a detersive surfactant system comprising $C_{10-20}$ linear alkyl benzene sulfonates, $C_{10-20}$ alkyl sulfates, $C_{10-18}$ alkyl ethoxy sulfates having from about 1 to about 7 ethoxy groups, alcohol ethoxylates, and polyethylene glycol. This step results in the formation of detergent agglomerates.

Next, the detergent agglomerates are mixed in a moderate speed mixer/densifier so as to further form the detergent agglomerates. Lastly, the detergent agglomerates are dried so as to form an agglomerated detergent composition has a density of at least about 650 g/l. The paste process preferably further comprises the step of adding a coating agent. The agglomerates of the agglomerated detergent composition have a median particle size of from about 300 microns to about 600 microns. The viscosity of the surfactant paste is preferably from about 10,000 centipoises to about 100,000 centipoises.

In another aspect of the invention, a second process for making the agglomerated detergent composition, referred to herein as the "neutralization" process, is provided. The first step in the neutralization method comprises blending secondary (2,3) alkyl sulfate with a detergency builder to form a homogeneous powder mixture. Next, a liquid acid precursor for $C_{10-20}$ linear alkyl benzene sulfonate is combined with the homogeneous powder mixture in a high speed mixer/densifier to form detergent agglomerates. A final optional step in the neutralization process involves mixing the detergent agglomerates in a moderate speed mixer/densifier to further form and build-up the detergent agglomerates. The agglomerated detergent composition has a density of at least about 650 g/l. Optionally, the detergent agglomerates formed by the neutralization process can be cooled.

In accordance with another aspect of the invention, a method for laundering soiled fabrics is provided. The method comprises the step of contacting the soiled fabrics with an effective amount of a granular detergent composition as described herein in an aqueous laundering solution.

Accordingly, it is an object of the present invention to provide an agglomerated high density detergent composition containing secondary (2,3) alkyl sulfate surfactant and processes for making the agglomerated high density detergent composition. These and other objects, features and attendant advantages of the present invention will become apparent to those skilled in the art from reading of the following detailed description of the preferred embodiment and the appended claims.

DETAILED DESCRIPTION OF THE PREFERRED EMBODIMENT

The invention is directed to an agglomerated high density detergent composition containing secondary (2,3) alkyl sulfate and to a process for producing the agglomerated detergent composition. Secondary (2,3) alkyl sulfates are useful in the formulation of granular and agglomerated detergent compositions because they are biodegradable and because they are compatible with enzymes, a common ingredient in commercially available detergent compositions. However, poor solubility of the secondary (2,3) alkyl sulfates, especially in cold wash water environments, precludes their extensive use in most detergent formulations.

The present invention overcomes problems associated with the use of secondary (2,3) alkyl sulfates and provides an agglomerated high density detergent composition and a method for producing the detergent composition. The secondary (2,3) alkyl sulfate agglomerate and its processing in the manner of the present invention are described in detail, hereinafter. Other ingredients which can be used to prepare fully-formulated detergent compositions are also disclosed for the convenience of the formulator, but are not intended to be limiting thereof.

The detergent composition of the present invention must include the aforementioned detersive surfactant system and a detergency builder. Adjunct detergent ingredients, which include conventional formulation ingredients for use in detergents, optionally may be included in the detergent composition, as well. Nonlimiting examples of the surfactant, builder and preferred adjunct enzymes, bleaching compounds, bleaching agents and bleach activators, polymeric soil release agents, dye transfer inhibiting agents, chelating agents, clay soil removal and anti-redeposition agents, suds suppressors, fabric softeners and other miscellaneous ingredients are described in detail hereinafter.

Surfactant

Nonlimiting examples of surfactants which can be used herein in addition to or as part of the SAS agglomerates, typically at levels from about 1% to about 50%, by weight, include the conventional $C_{11}$–$C_{18}$ alkyl benzene sulfonates ("LAS") and primary, branched-chain and random $C_{10}$–$C_{20}$ alkyl sulfates ("AS"), unsaturated sulfates such as oleyl sulfate, the $C_{10}$–$C_{18}$ alkyl ethoxy sulfates ("$AE_xS$"; especially EO 1–7 ethoxy sulfates), $C_{10}$–$C_{18}$ alkyl ethoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. The detergent agglomerates described herein preferably comprise $C_{12}$–$C_{14}$ alkyl benzene sulfonates. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Conventional secondary alkyl sulfate surfactants, which are incorporated in the agglomerated detergent composition disclosed herein, are those materials which have the sulfate moiety distributed randomly along the hydrocarbyl "backbone" of the molecule. Such materials may be depicted by the structure:

$$CH_3(CH_2)_n(CHOSO_3^-M^+)(CH_2)_mCH_3$$

wherein m and n are integers of 2 or greater and the sum of m+n is typically about 9 to 17, and M is a water-solubilizing cation.

The selected secondary (2,3) alkyl sulfate surfactants used herein comprise structures of formulas A and B:

$$CH_3(CH_2)_x(CHOSO_3^-M^+)CH; \quad (A)$$

and $$CH_3(CH_2)_y(CHOSO_3^-M^+)CH_2CH_3 \quad (B)$$

for the 2-sulfate and 3-sulfate, respectively. Mixtures of the 2- and 3-sulfate can be used herein. In formulas A and B, x and (y+1) are, respectively, integers of at least about 6, and can range from about 7 to about 20, preferably about 10 to about 16. M is a cation, such as an alkali metal, ammonium, alkanolammonium, alkaline earth metal, or the like. Sodium is typical for use as M to prepare the water-soluble secondary (2,3) alkyl sulfates, but ethanolammonium, diethanolammonium, triethanolammonium, potassium, ammonium, and the like, can also be used. Materials A and B, and mixtures thereof, are abbreviated "SAS", herein.

With regard to the random secondary alkyl sulfates (i.e., secondary alkyl sulfates with the sulfate group at positions such as the 4, 5, 6, 7, etc. secondary carbon atoms), such materials tend to be tacky solids or, more generally, pastes. Thus, the random alkyl sulfates do not afford the processing advantages associated with the solid SAS when formulating detergent granules. Moreover, SAS provides better sudsing than the random mixtures. It is preferred that SAS be substantially free (i.e., contain less than about 20%, more preferably less than about 10%, most preferably less than about 5%) of such random secondary alkyl sulfates.

One additional advantage of the SAS surfactants herein over other positional or "random" alkyl sulfate isomers is in regard to the improved benefits afforded by said SAS with respect to soil redeposition in the context of fabric laundering operations. As is well-known to users, laundry detergents loosen soils from fabrics being washed and suspend the soils in the aqueous laundry liquor. However, as is well-known to detergent formulators, some portion of the suspended soil can be redeposited back onto the fabrics. Thus, some redistribution and redeposition of the soil onto all fabrics in the load being washed can occur. This, of course, is undesirable and can lead to the phenomenon known as fabric "graying". (As a simple test of the redeposition characteristics of any given laundry detergent formulation, unsoiled white "tracer" cloths can be included with the soiled fabrics being laundered. At the end of the laundering operation the extent to which the white tracers deviate from their initial degree of whiteness can be measured photometrically or estimated visually by skilled observers. The more the tracers' whiteness is retained, the less soil redeposition has occurred.)

It has also been determined that SAS affords substantial advantages in soil redeposition characteristics over the other positional isomers of secondary alkyl sulfates in laundry detergents, as measured by the cloth tracer method noted above. Thus, the selection of SAS surfactants according to the practice of this invention which preferably are substantially free of other positional secondary isomers unexpectedly assists in solving the problem of soil redeposition in a manner not heretofore recognized.

It is to be noted that the SAS used herein is quite different in several important properties from the secondary olefin sulfonates (e.g., U.S. Pat. No. 4,064,076, Klisch et al, Dec. 20, 1977); accordingly, such secondary sulfonates are not the focus of the present invention.

The preparation of SAS of the type useful herein can be carried out by the addition of $H_2SO_4$ to olefins. A typical synthesis using α-olefins and sulfuric acid is disclosed in U.S. Pat. No. 3,234,258, Morris, or in U.S. Pat. No. 5,075,041, Lutz, granted Dec. 24, 1991, both of which are incorporated herein by reference. The synthesis, conducted in solvents which afford the SAS on cooling, yields products which, when purified to remove the unreacted materials, randomly sulfated materials, unsulfated by-products such as $C_{10}$ and higher alcohols, secondary olefin sulfonates, and the like, are typically 90+% pure mixtures of 2- and 3-sulfated materials (up to 10% sodium sulfate is typically present) and are white, non-tacky, apparently crystalline, solids. Some 2,3-disulfates may also be present, but generally comprise no more than 5% of the mixture of secondary (2,3) alkyl mono-sulfates.

If still further increases in the solubility of the "crystalline" SAS surfactants are desired, the formulator may wish to employ mixtures of such surfactants having a mixture of alkyl chain lengths. Thus, a mixture of $C_{12}$–$C_{18}$ alkyl chains will provide an increase in solubility over an SAS wherein the alkyl chain is, say, entirely $C_{16}$. When formulating detergent compositions using the soluble particles provided by this invention, it may be desirable that the SAS surfactants contain less than about 3% sodium sulfate. preferably less than about 1% sodium sulfate. In and of itself, sodium sulfate is an innocuous material. However, it provides no cleaning function in the compositions and may constitute a load on the system when dense granules are being formulated.

Various means can be used to lower the sodium sulfate content of the SAS. For example, when the $H_2SO_4$ addition to the olefin is completed, care can be taken to remove unreacted $H_2SO_4$ before the acid form of the SAS is neutralized. In another method, the sodium salt form of the SAS which contains sodium sulfate can be rinsed with water at a temperature near or below the Krafft temperature of the sodium SAS. This will remove $Na_2SO_4$ with only minimal loss of the desired, purified sodium SAS. Of course, both procedures can be used, the first as a pre-neutralization step and the second as a post-neutralization step.

The term "Krafft temperature" as used herein is a term of art which is well-known to workers in the field of surfactant sciences. Krafft temperature is described by K. Shinoda in the text "Principles of Solution and Solubility", translation in collaboration with Paul Becher, published by Marcel Dekker, Inc. 1978 at pages 160–161. Stated succinctly, the solubility of a surface active agent in water increases rather slowly with temperature up to that point, i.e., the Krafft temperature, at which the solubility evidences an extremely rapid rise. At a temperature approximately 4° C. above the Krafft temperature a solution of almost any composition becomes a homogeneous phase. In general, the Krafft temperature of any given type of surfactant, such as the SAS herein which comprises an anionic hydrophilic sulfate group and a hydrophobic hydrocarbyl group, will vary with the chain length of the hydrocarbyl group. This is due to the change in water solubility with the variation in the hydrophobic portion of the surfactant molecule.

The formulator may optionally wash the SAS surfactant which is contaminated with sodium sulfate with water at a temperature that is no higher than the Krafft temperature, and which is preferably lower than the Krafft temperature, for the particular SAS being washed. This allows the sodium sulfate to be dissolved and removed with the wash water, while keeping losses of the SAS into the wash water to a minimum.

Under circumstances where the SAS surfactant herein comprises a mixture of alkyl chain lengths, it will be appreciated that the Krafft temperature will not be a single point but, rather, will be denoted as a "Krafft boundary". Such matters are well-known to those skilled in the science of surfactant/solution measurements. In any event, for such mixtures of SAS, it is preferred to conduct the optional sodium sulfate removal operation at a temperature which is below the Krafft boundary, and preferably below the Krafft temperature of the shortest chain-length surfactant present in such mixtures, since this avoids excessive losses of SAS to the wash solution. For example, for $C_{16}$ secondary sodium alkyl (2,3) sulfate surfactants, it is preferred to conduct the washing operation at temperatures below about 30° C., preferably below about 20° C. It will be appreciated that changes in the cations will change the preferred temperatures for washing the SAS surfactants, due to changes in the Krafft temperature.

The washing process can be conducted batchwise by suspending wet or dry SAS in sufficient water to provide 10% to 50% solids, typically for a mixing time of at least 10 minutes at about 22° C. (for a $C_{16}$ SAS), followed by pressure filtration. In a preferred mode, the slurry will comprise somewhat less than 35% solids, inasmuch as such slurries are free-flowing and amenable to agitation during the washing process. As an additional benefit, the washing process also reduces the levels of organic contaminants which comprise the random secondary alkyl sulfates noted above.

SAS powder has poor solubility, especially in cold water conditions. The discovery that SAS powder solubility can be improved by agglomerating SAS with various surfactant paste mixtures and detergency builders is unexpected. Two processes have been discovered which result in improved solubility of SAS. The first is referred to herein as the paste process. In this process, SAS and detergency builders powders are agglomerated with a surfactant paste mixture. The second process is referred to herein as the neutralization process. In this process, SAS and detergency builders are mixed with a liquid acid precursor of linear alkylbenzene sulfonate to form detergent agglomerates.

The soluble agglomerates provided in the agglomerated detergent composition and processes herein preferably contain from about 10% to about 70%, more preferably from about 15% to about 50%, and most preferably from about 20% to about 30% of a secondary (2,3) alkyl sulfate surfactant.

While not intended to be limited by theory, it is hypothesized that the mechanical input from the high speed mixing device to the surfactant paste mixture and the blended secondary (2,3) alkyl sulfate surfactant provide sufficient energy to provide a phase change to the crystalline secondary (2,3) alkyl sulfate surfactant. The phase change to a less crystalline surfactant phase thus affords the improved solubility.

While not intended to be limited by theory, it is also hypothesized that the mechanical input from the mixing device(s) and the additional chemical energy from the exothermic heat of neutralization of the liquid acid pre-cursor for $C_{10-20}$ linear alkyl benzene sulfonate with the detergency builder (specifically, sodium carbonate) to the secondary (2,3) alkyl sulfate surfactant provide sufficient energy to provide a phase change to the crystalline secondary (2,3) alkyl sulfate surfactant. The phase change to a less crystalline surfactant phase thus affords the improved solubility.

SAS Processing

The agglomerates of the invention can be made by two methods: one involving the use of a surfactant paste (hereinafter the "paste process") and a second involving the use of liquid acid precursors of $C_{10-20}$ linear alkylbenzene sulfonate, (hereinafter the "neutralization process"). In the first step of the paste process, secondary (2,3) alkyl sulfate is blended with detergency builder to form a homogeneous powder mixture. The preferred detergency builders comprise those selected from the group consisting of carbonate, aluminosilicate, zeolite and mixtures thereof.

In the next step of the paste process, the homogeneous powder mixture is agglomerated with a surfactant paste mixture to form detergent agglomerates. The surfactant paste mixture preferably comprises from about 1% to about 80% by weight of a detersive surfactant system which comprises $C_{10-20}$ linear alkylbenzene sulfonates, $C_{10-20}$ alkyl sulfates, $C_{10-18}$ alkyl ethoxy sulfates having from about 1 to about 7 ethoxy groups, alcohol ethoxylates, and polyethylene glycol.

To achieve the desired density of 650 g/l, the above-mentioned mixing steps of the paste process can be carried forth initially in a high speed mixer/densifier after which a moderate speed mixer/densifier can follow, wherein the starting detergent materials are agglomerated and densified to produce particles having a density of at least 650 g/l and. more preferably from about 700 g/l to about 800 g/l. Preferably, the mean residence time of the starting detergent materials in the high speed mixer/densifier (e.g. Lödige Recycler CB30) is from about 1 to 30 seconds while the residence time in low or moderate speed mixer/densifier (e.g. Lödige Recycler KM 300 "Ploughshare") is from about 0.25 to 10 minutes. Alternatively, the agglomeration step of the paste process contemplates achieving the desired density of the starting detergent materials by agglomeration in a single moderate speed mixer/densifier wherein the residence time is increased, for example, up to about 15 minutes.

For purposes of facilitating agglomeration, detergency builders are blended with SAS just prior to adding the surfactant paste mixture. While not intending to be limited by theory, it is believed that the free flowing, high density detergent agglomerates produced by the present invention is attributed to the absorption of the excess water typically contained in the viscous surfactant paste by the detergency builder during or just prior to agglomeration.

The surfactant paste mixture described above is highly viscous. In the instant invention, the surfactant paste preferably has as viscosity of from about 10,000 centipoises (cps) to about 100,000 cps. More preferably, the viscosity of the surfactant paste used in the paste process is from 10,000 cps to 80,000 cps.

The detergent agglomerates produced by the paste process preferably have a surfactant level of from about 1% to about 70%, more preferably from about 20% to about 55%, even more preferably from about 35% to about 50% and, most preferably from about 40% to about 45%. Such detergent agglomerates are particularly useful in the production of low dosage detergents. An attribute of dense or densified agglomerates is the relative median particle size. The present paste process typically provides detergent agglomerates having a median particle size of from about 300 microns to about 600 microns, and more preferably from about 400 microns to about 600 microns. The above-referenced particle size results in an agglomerated detergent composition having density values of 650 g/l and higher. Such a feature is especially useful in the production of low dosage laundry detergents as well as other granular compositions such as dishwashing compositions. A preferred embodiment of the invention is a granular detergent composition comprising conventional formulation ingredients and at least about 5% by weight of the agglomerated detergent composition prepared according to the paste process. In another preferred embodiment of the invention, a method for laundering soiled fabrics is provided. The method comprises the step of contacting soiled fabrics with an effective amount of a granular detergent composition which comprises at least about 10% to about 65% by weight of the agglomerated detergent composition described herein.

As mentioned above, the agglomerates of the invention can be produced by the neutralization process. The neutralization process comprises the steps of first, blending secondary (2,3) alkyl sulfate with a detergency builder to form a homogeneous powder mixture. The detergency builder is preferably one selected from the group consisting of alkali metals, ammonium phosphates, substituted ammonium phosphates, citric acid, aluminosilicates, carbonates, silicates, borates, polyhydroxy sulfonates, polyacetate carboxylates, polycarboxylates, zeolite and mixtures thereof.

Next, in the neutralization process, the homogeneous powder mixture described above is mixed with a liquid acid precursor of $C_{10-20}$ linear alkylbenzene sulfonate in a high speed mixer/densifier to from detergent agglomerates. Preferably, the mean residence time of the starting detergent materials in the high speed mixer/densifier (e.g. Lödige Recycler CB30) is from about 1 to 30 seconds. The detergent agglomerates formed at this stage are then optionally further mixed in a moderate speed mixer/densifier. The residence time in the low or moderate speed mixer/densifier (e.g. L ödige Recycler KM 300 "Ploughshare") is from about 0 to 10 minutes. Preferably, the detergent agglomerates are then cooled so as to form a detergent composition which has a density of at least about 650 g/l. In another embodiment of the neutralization process, a coating agent can be added at the step carried out in the moderate speed mixer/densifier.

The particles of the agglomerated detergent composition produced by the neutralization process preferably have a median particle size of from about 300 microns to about 600 microns. In a preferred embodiment of the invention, a granular detergent composition is made by combining at least about 10% to about 65% by weight of the agglomerated detergent composition, made according to the neutralization process, with conventional formulation ingredients. In another preferred embodiment of the invention involving a method of laundering soiled fabrics, the fabrics are contacted with an effective amount of a granular detergent composition, comprising detergent agglomerated made according to the neutralization process, in an aqueous laundering solution.

Optional Agglomeration Process Steps

Either the paste or the neutralization process can comprise the additional step of spraying an additional binder in the mixer/densifier(s) used in the agglomeration step to facilitate production of the desired detergent agglomerates. A binder is added for purposes of enhancing agglomeration by providing a "binding" or "sticking" agent for the detergent components. The binder is preferably selected from the group consisting of water, anionic surfactants, nonionic surfactants, polyethylene glycol, polyacrylates, citric acid and mixtures thereof. Other suitable binder materials including those listed herein are described in Beerse et al, U.S. Pat. No. 5,108,646 (The Procter & Gamble Company).

Another optional step contemplated by the present process includes conditioning the detergent agglomerates by either drying, cooling, or adding a coating agent to improve flowability after they exit the mixer/densifier(s) used in agglomeration. This furthers enhances the condition of the detergent agglomerates for use as an additive or to place them in shippable or packagable form. The coating agent can be any ingredient which enhances the flowability or low characteristics of the detergent SAS agglomerates. By way of example, various aluminosilicates, zeolites and carbonates can be used. Those skilled in the art will appreciate that a wide variety of methods may be used to dry as well as cool the exiting detergent agglomerates without departing from the scope of the invention. By way of example, apparatus such as a fluidized bed can be used for drying and/or cooling while an airlift can be used for cooling should it be necessary.

Builders

Detergent builders must be included in the compositions herein to assist in controlling mineral, especially Ca and/or Mg, hardness in wash water or to assist in the removal of particulate soils from surfaces. Builders can operate via a variety of mechanisms including forming soluble or insoluble complexes with hardness ions, by ion exchange, and by offering a surface more favorable to the precipitation of hardness ions than are the surfaces of articles to be cleaned. Builder level can vary widely depending upon end use and physical form of the composition. Built detergents typically comprise at least about 1% builder. Granular formulations typically comprise from about 10% to about 80%, more typically 15% to 50% builder by weight of the detergent composition. The agglomerated detergent composition described herein comprises at least about 1% by weight of a detergency builder. Lower or higher levels of builders are not excluded. For example, certain detergent additive or high-surfactant formulations can be unbuilt.

Suitable builders herein can be selected from the group consisting of phosphates and polyphosphates, especially the sodium salts; silicates including water-soluble and hydrous solid types and including those having chain-, layer-, or three-dimensional-structure as well as amorphous-solid or non-structured-liquid types; carbonates, bicarbonates, sesquicarbonates and carbonate minerals other than sodium carbonate or sesquicarbonate; aluminosilicates; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions. The agglomerated detergent composition according to the present invention preferably contains builder selected from the group consisting of alkali metal, ammonium phosphates, substituted ammonium phosphates, citric acid, aluminosilicates, carbonates, silicates, borates, polyhydroxy sulfonates, polyacetate carboxylates, polycarboxylates, zeolite and mixtures thereof. More preferably, the agglomerated detergent composition of the invention contains aluminosilicates, zeolites, and/or carbonates as builder.

Builder mixtures, sometimes termed "builder systems" can be used and typically comprise two or more conventional builders, optionally complemented by chelants, pH-buffers or fillers, though these latter materials are generally accounted for separately when describing quantities of materials herein. In terms of relative quantities of surfactant and builder in the present detergents, preferred builder systems are typically formulated at a weight ratio of surfactant to builder of from about 60:1 to about 1:80. The surfactant to builder ratio of the agglomerated detergent composition of the present invention preferably ranges from 1:5 to about 5:1.

Phosphate-containing detergent builders often preferred where permitted by legislation include, but are not limited to, the alkali metal, ammonium and alkanolammonium salts of polyphosphates exemplified by the tripolyphosphates, pyrophosphates, glassy polymeric meta-phosphates; and phosphonates. The agglomerated detergent composition contained herein is substantially free of phosphates.

Suitable silicate builders include alkali metal silicates, particularly those liquids and solids having a $SiO_2$:$Na_2O$ ratio in the range 1.6:1 to 3.2:1, including, particularly for automatic dishwashing purposes, solid hydrous 2-ratio silicates marketed by PQ Corp. under the tradename BRITESIL®, e.g., BRITESIL H2O; and layered silicates, e.g., those described in U.S. Pat. No. 4,664,839, May 12, 1987, H. P. Rieck. NaSKS-6, sometimes abbreviated "SKS-6", is a crystalline layered aluminum-free $\delta$-$Na_2SiO_5$ morphology silicate marketed by Hoechst and is preferred especially in granular laundry compositions. See preparative methods in German DE-A-3,417,649 and DE-A-3,742,043. Other layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0, can also or alternately be used herein. Layered silicates from Hoechst also include NaSKS-5, NaSKS-7 and NaSKS-11, as the $\alpha$, $\beta$ and $\gamma$ layer-silicate forms. Other silicates may also be useful, such as magnesium silicate, which can serve as a crispening agent in granules, as a stabilizing agent for bleaches, and as a component of suds control systems.

Also suitable for use herein are synthesized crystalline ion exchange materials or hydrates thereof having chain structure and a composition represented by the following general formula in an anhydride form: $xM_2O.ySiO_2.zM'O$ wherein M is Na and/or K, M' is Ca and/or Mg; y/x is 0.5 to 2.0 and z/x is 0.005 to 1.0 as taught in U.S. Pat. No. 5,427,711, Sakaguchi et al, Jun. 27, 1995.

Suitable carbonate builders include alkaline earth and alkali metal carbonates as disclosed in German Patent Application No. 2,321,001 published on Nov. 15, 1973, although sodium bicarbonate, sodium carbonate, sodium sesquicarbonate, and other carbonate minerals such as trona or any convenient multiple salts of sodium carbonate and calcium carbonate such as those having the composition $2Na_2CO_3.CaCO_3$ when anhydrous, and even calcium carbonates including calcite, aragonite and vaterite, especially forms having high surface areas relative to compact calcite may be useful, for example as seeds or for use in synthetic detergent bars.

Aluminosilicate builders are especially useful in granular detergents, but can also be incorporated in liquids, pastes or gels. Suitable for the present purposes are those having empirical formula: $[M_z(AlO_2)_z(SiO_2)_v].xH_2O$ wherein z and v are integers of at least 6, the molar ratio of z to v is in the range from 1.0 to 0.5, and x is an integer from 15 to 264. Aluminosilicates can be crystalline or amorphous, naturally-occurring or synthetically derived. An aluminosilicate production method is in U.S. Pat. No. 3,985,669, Krummel, et al, Oct. 12, 1976. Preferred synthetic crystalline aluminosilicate ion exchange materials are available as Zeolite A, Zeolite P (B), Zeolite X and, to whatever extent this differs from Zeolite P, the so-called Zeolite MAP. Natural types, including clinoptilolite, may be used. Zeolite A has the formula: $Na_{12}[(AlO_2)_{12}(SiO_2)_{12}].xH_2O$ wherein x is from 20 to 30, especially 27. Dehydrated zeolites (x=0–10) may also be used. Preferably, the aluminosilicate has a particle size of 0.1–10 microns in diameter.

Suitable organic detergent builders include polycarboxylate compounds, including water-soluble nonsurfactant dicarboxylates and tricarboxylates. More typically builder polycarboxylates have a plurality of carboxylate groups, preferably at least 3 carboxylates. Carboxylate builders can be formulated in acid, partially neutral, neutral or overbased form. When in salt form, alkali metals, such as sodium, potassium, and lithium, or alkanolammonium salts are preferred. Polycarboxylate builders include the ether polycarboxylates, such as oxydisuccinate, see Berg, U.S. Pat. No. 3,128,287, Apr. 7, 1964, and Lamberti et al, U.S. Pat. No. 3,635,830, Jan. 18, 1972; "TMS/TDS" builders of U.S. Pat. No. 4,663,071, Bush et al, May 5, 1987; and other ether carboxylates including cyclic and alicyclic compounds, such as those described in U.S. Pat. Nos. 3,923,679; 3,835,163; 4,158,635; 4,120,874 and 4,102,903.

Other suitable builders are the ether hydroxypolycarboxylates, copolymers of maleic anhydride with ethylene or vinyl methyl ether; 1,3,5-trihydroxy benzene-2,4,6-trisulphonic acid; carboxymethyloxysuccinic acid; the various alkali metal, ammonium and substituted ammonium salts of polyacetic acids such as ethylenediamine tetraacetic acid and nitrilotriacetic acid; as well as mellitic acid, succinic acid, polymaleic acid, benzene 1,3,5-tricarboxylic acid, carboxymethyloxysuccinic acid, and soluble salts thereof.

Citrates, e.g., citric acid and soluble salts thereof are important carboxylate builders e.g., for heavy duty liquid detergents, due to availability from renewable resources and biodegradability. Citrates can also be used in granular compositions, especially in combination with zeolite and/or layered silicates. Oxydisuccinates are also especially useful in such compositions and combinations.

Where permitted, and especially in the formulation of bars used for hand-laundering operations, alkali metal phosphates such as sodium tripolyphosphates, sodium pyrophosphate and sodium orthophosphate can be used. Phosphonate builders such as ethane-1-hydroxy-1,1-diphosphonate and other known phosphonates, e.g., those of U.S. Pat. Nos. 3,159,581; 3,213,030; 3,422,021; 3,400,148 and 3,422,137 can also be used and may have desirable antiscaling properties.

Certain detersive surfactants or their short-chain homologs also have a builder action. For unambiguous formula accounting purposes, when they have surfactant capability, these materials are summed up as detersive surfactants. Preferred types for builder functionality are illustrated by: 3,3-dicarboxy-4-oxa-1,6-hexanedioates and the related compounds disclosed in U.S. Pat. No. 4,566,984, Bush, Jan. 28, 1986. Succinic acid builders include the $C_5$–$C_{20}$ alkyl and alkenyl succinic acids and salts thereof. Succinate builders also include: laurylsuccinate, myristylsuccinate, palmitylsuccinate, 2-dodecenylsuccinate (preferred), 2-pentadecenylsuccinate, and the like. Laurylsuccinates are described in European Patent Application 86200690.5/0,200,263, published Nov. 5, 1986. Fatty acids, e.g., $C_{12}$–$C_{18}$ monocarboxylic acids, can also be incorporated into the compositions as surfactant/builder materials alone or in combination with the aforementioned builders, especially citrate and/or the succinate builders, to provide additional builder activity. Other suitable polycarboxylates are disclosed in U.S. Pat. No. 4,144,226, Crutchfield et al, Mar. 13, 1979 and in U.S. Pat. No. 3,308,067, Diehl, Mar. 7, 1967. See also Diehl. U.S. Pat. No. 3,723,322.

Optionally, inorganic builder materials can be used which have the formula $(M_x)_i\ Ca_y(CO_3)_z$ wherein x and i are integers from 1 to 15, y is an integer from 1 to 10, z is an integer from 2 to 25, $M_i$ are cations, at least one of which is a water-soluble, and the equation $\Sigma_{i=1-15}(x_i$ multiplied by the valence of $M_i)+2y=2z$ is satisfied such that the formula has a neutral or "balanced" charge. Waters of hydration or anions other than carbonate may be added provided that the overall charge is balanced or neutral. The charge or valence effects of such anions should be added to the right side of the above equation. Preferably, there is present a water-soluble cation selected from the group consisting of hydrogen, water-soluble metals, hydrogen, boron, ammonium, silicon, and mixtures thereof, more preferably, sodium, potassium, hydrogen, lithium, ammonium and mixtures thereof, sodium and potassium being highly preferred. Nonlimiting examples of noncarbonate anions include those selected from the group consisting of chloride, sulfate, fluoride, oxygen, hydroxide, silicon dioxide, chromate, nitrate, borate and mixtures thereof. Preferred builders of this type in their simplest forms are selected from the group consisting of $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and combinations thereof. An especially preferred material for the builder described herein is $Na_2Ca(CO_3)_2$ in any of its crystalline modifications. Suitable builders of the above-defined type are further illustrated by, and include, the natural or synthetic forms of any one or combinations of the following minerals: Afghanite, Andersonite, Ashcroftine Y, Beyerite, Borcarite, Burbankite, Butschliite, Cancrinite, Carbocernaite, Carletonite, Davyne, Donnayite Y, Fairchildite, Ferrisurite, Franzinite, Gaudefroyite, Gaylussite, Girvasite, Gregoryite, Jouravskite, Kamphaugite Y, Kettnerite, Khanneshite, LepersonniteGd, Liottite, Mckelveyite Y, Microsommite, Mroseite, Natrofairchildite, Nyerereite, RemonditeCe, Sacrofanite, Schrockingerite, Shortite, Surite, Tunisite, Tuscanite, Tyrolite, Vishnevite, and Zemkorite. Preferred mineral forms include Nyererite, Fairchildite and Shortite.

Adjunct Formulation Ingredients

The fully-formulated granular detergent compositions which are prepared using the SAS agglomerates of this invention will typically comprise various other formulation ingredients to provide auxiliary cleaning and fabric care benefits, aesthetic benefits and processing aids. The following are non-limiting examples of builders, enzymes, enzyme stabilizers, bleaching compounds, including bleaching agents and bleach activators, polymeric soil release agents, dye transfer inhibiting agents, chelating agents, clay soil removal and anti-redeposition agents, fabric softeners, detersive surfactants and other miscellaneous ingredients which are typical for use in the commercial practice of the present invention, especially to provide high quality fabric laundry detergent compositions.

Enzymes—Enzymes can be optionally included in the formulations herein for a wide variety of fabric laundering purposes, including removal of protein-based, carbohydrate-based, or triglyceride-based stains, for example, and for the prevention of fugitive dye transfer, and for fabric restoration. Enzymes preferably included in the agglomerated detergent composition herein are those selected from the group consisting of proteases, amylases, lipases, cellulases, lipases and mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.01% to about 2%, preferably 0.01%–1% by weight of an enzyme. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *Bacillus subtilis* and *Bacillus licheniforms.* Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Ser. No. 87303761.8, filed Apr. 28, 1987, and European Patent Application 130,756, Bott et al, published Jan. 9, 1985).

Amylases include, for example, -amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984. which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (*Dolabella Auricula Solander*). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g. *Chromobacter viscosum* var. *lipolyticum* NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli.* The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Bleaching Compounds—Bleaching Agents and Bleach Activators—The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1.250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-oct-anamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

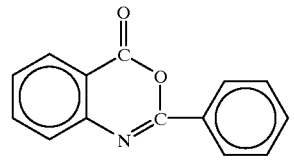

Still another class of preferred bleach activators includes the acyl lactam activators, especially acyl caprolactams and acyl valerolactams of the formulae:

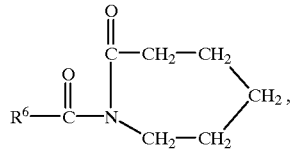

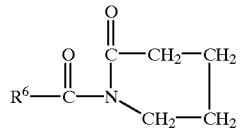

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}{}_2(u\text{-}O)_3$(1,4,7-trimethyl-1,4,7-triazacyclononane)$2(PF_6)_2$, $Mn^{III}{}_2(u\text{-}O)_1(u\text{-}O\text{—}Ac)_2$(1,4,7-trimethyl-1,4,7-triazacyclononane)$_2$—$(ClO_4)_2$, $Mn^{IV}{}_4(u\text{-}O)_6$(1,4,7-triazacyclononane)$_4(ClO_4)_4$, $Mn^{III}Mn^{IV}{}_4(u\text{-}O)_1(u\text{-}OAc)_2$-(1,4,7-trimethyl-1,4,7-triazacyclononane)$2(ClO_4)_3$, $Mn^{IV}$(1,4,7-trimethyl-1,4,7-triazacyclononane)-$(OCH_3)_3$ $(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm. of the catalyst species in the laundry liquor.

Polymeric Soil Release Agent—Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate: $C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from DuPont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730. issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

If utilized, soil release agents will generally comprise from about 0.01% to about 10.0%, by weight, of the detergent compositions herein, typically from about 0.1% to about 5%, preferably from about 0.2% to about 3.0%.

Dye Transfer Inhibiting Agents—The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic. ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

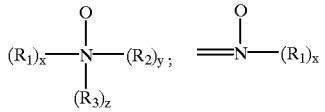

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1. more preferably from 0.8:1 to 0.3:1. most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 11:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

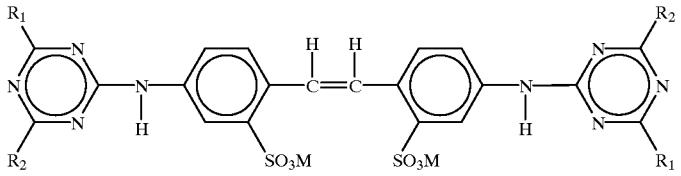

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates (DTPA), and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Suds Suppressors—Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, laundry detergent compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %: and without polypropylene glycol. Similar amounts can be used in granular compositions, gels, etc. See also U.S. Pat. Nos. 4,978,471, Starch, issued Dec. 18, 1990, and 4,983,316, Starch, issued Jan. 8, 1991, 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Fabric Softeners—Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

Other Ingredients—A wide variety of other ingredients useful in detergent compositions can be included in the compositions herein, including other active ingredients, carriers, processing aids, dyes or pigments, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents.

The detergent compositions herein will preferably be formulated such that, during use in aqueous cleaning operations, the wash water will have a pH of between about 6.5 and about 11, preferably between about 7.5 and 11.0. Fabric laundry products are typically at pH 9–11. Techniques for controlling pH at recommended usage levels include the use of buffers, alkalis, acids, etc., and are well known to those skilled in the art.

EXAMPLES I–X

Two processes for producing agglomerates according to the invention are exemplified below in Examples I and II. In addition, several detergent compositions made in accordance with the invention are exemplified in Examples III to X.

Example I

Example I illustrates the process of the invention which produces free flowing, high density detergent agglomerates using the "paste process". A batch version of the present process is described hereinafter. Initially, 200 grams of a powdered builder mixture (hereinafter referenced as the "builder") comprising zeolite A and sodium carbonate in a weight ratio of 1.7:1 (47% by weight) and 100 grams of $C_{16}$ secondary (2,3) alkyl sulfate surfactant are blended into a lab-scale, high-shear mixer (Regal La Machine® II) to form a homogeneous powder mixture. Thereafter, 200 grams surfactant paste (at 65° C.) are fed into the mixer and blended with the homogeneous powder mixture. The surfactant paste comprises an aqueous paste composition comprising 73% by weight of $C_{11}$–$C_{18}$ alkyl benzene sulfonates ("LAS") and $C_{12-15}$ alkyl sulfate and in a ratio of 25:75, and 20% water. The mixer is run until agglomerates are formed. In a continuous version of this process, the detergent agglomerates would be further built-up in a moderate speed mixer/densifier. Subsequent oven drying (2–4 hours at 75° C.) will reduce the moisture to the desired level. The resulting detergent agglomerates have a density in a range from about 650 to 750 g/l and a median particle size between about 400 to about 600 microns.

Example II

Example II illustrates the process of the invention which produces free flowing, high density detergent agglomerates using the neutralization process. A batch version of the present process is described hereinafter. Initially, 280 grams of a powdered builder mixture (hereinafter referenced as the "builder") comprising zeolite A and sodium carbonate in a weight ratio of 1:2.2 (56% by weight) and 100 grams of $C_{16}$ secondary (2,3) alkyl sulfate surfactant are blended into a lab-scale, high-shear mixer (Regal La Machine® II) to form a homogeneous powder mixture. Thereafter, the liquid acid precursor of $C_{10-20}$ linear alkylbenzene sulfonate (hereinafter referred to as "acid"), at 60° C., is continuously fed into the high shear mixer/densifier at a rate of 100 g/min until agglomerates are produced. The resulting detergent agglomerates have a density in a range from about 650 to 750 g/l and a median particle size between about 400 to about 600 microns.

Examples III–VI

SAS agglomerates prepared in the foregoing manner are used to provide fully-formulated detergent compositions, as illustrated by the following, non-limiting formulations in Examples III to VI. Example III exemplifies detergent agglomerates which it is possible to make using the paste process and Examples IV–VI exemplify detergent agglomerates which it is possible to make using the neutralization process.

| Components | III | IV | V | VI |
|---|---|---|---|---|
| $C_{12-14}$ alkylbenzene sulfonate | 7.5 | 20.2 | 20.2 | 25.4 |
| $C_{14-15}$ alkyl sulfate | 22.5 | — | — | — |
| $C_{10-20}$ secondary alkyl (2,3) sulfate | 18.5 | 17.8 | 17.8 | 29.4 |
| Neodol $C_{23}$ E6.5 | — | 2.4 | 2.5 | — |
| Polyethylene glycol (MW = 4000) | 1.5 | 1.3 | — | — |
| Aluminosilicate | 24.0 | 29.1 | 17.3 | 16.3 |
| Sodium carbonate | 14.5 | 17.7 | 35.0 | 18.5 |
| Minors (water, unreactants) | 11.5 | 11.5 | 7.2 | 10.4 |
| | 100.0 | 100.0 | 100.0 | 100.0 |

Examples VII–X

SAS agglomerates prepared in the foregoing manner are used to provide fully-formulated detergent compositions, as illustrated by the following, non-limiting Examples. In Examples VII to X, the overall weight percent of the ingredients is listed in the vertical columns. $C_{10-20}$ secondary alkyl (2,3) sulfate agglomerates are prepared by the paste process in Example VII and by the neutralization process in Examples VIII through X.

| Components* | VII | VIII | IX | X |
|---|---|---|---|---|
| Surfactants | | | | |
| $C_{10-20}$ secondary alkyl (2,3) sulfate | 7.2 | 8.0 | 8.0 | 7.3 |
| $C_{45}$ alkyl sulfate | 12.8 | 2.6 | 2.6 | 3.2 |
| $C_{14}$–$C_{15}$ alcohol ethoxylate (1–3) sulfate | 1.6 | 1.0 | 1.0 | 1.2 |
| $C_{12-13}$ linear alkyl benzene sulfonate | 7.2 | 15.8 | 15.8 | 9.6 |
| Neodol $C_{23-26}$ E6.5–9 | 1.5 | 1.4 | 1.7 | 1.5 |
| Salts/Builder | | | | |
| Zeolite A | 23.4 | 26.5 | 22.3 | 28.0 |
| Sodium silicate (1.6r) | 0.6 | 0.6 | 0.6 | 0.6 |
| Polyacrylate Na (MW = 2,000–6,000) | 2.4 | 2.4 | 2.4 | 2.4 |
| Polyethylene glycol (MW = 4,000) | 1.6 | 1.1 | 1.1 | 1.0 |
| Sodium Carbonate | 24.5 | 21.2 | 28.2 | 25.4 |
| Sodium perborate | 1.0 | 1.1 | 1.1 | 1.0 |
| Sodium sulfate | 5.5 | 5.6 | 5.6 | 5.6 |
| Others | | | | |
| Perfume | 0.4 | 0.4 | 0.4 | 0.4 |
| Soil release polymer | 0.4 | 0.4 | 0.4 | 0.4 |
| Brighteners | 0.2 | 0.2 | 0.2 | 0.2 |
| Enzymes | 0.6 | 0.6 | 0.6 | 0.6 |
| Fumed silica | 0.4 | 0.4 | 0.4 | 0.4 |
| Miscellaneous Unreacted | 0.5 | 0.5 | 0.5 | 0.5 |
| Moisture | 8.2 | 10.2 | 7.1 | 11.7 |
| Total: | 100 | 100 | 100 | 100 |

*In Examples VII to X, the abbreviations used for certain Ingredients are defined as follows: NEODOL ® refers to nonionic surfactants commercially available from Shell Chemical Company; soil release polymer is an anionic polyester (see Maldonado and Gosselink and other patents cited above); Brighteners are TINOPALS ®, available from Ciba-Geigy.

Having thus described the invention in detail, it will be clear to those skilled in the art that various changes may be made without departing from the scope of the invention and the invention is not to be considered limited to what is described in the specification.

What is claimed is:

1. A process for making an agglomerated detergent composition comprising the steps of:

(a) blending secondary (2,3) alkyl sulfate with a member selected from the group consisting of carbonate, aluminosilicate, zeolite and mixtures thereof to form a homogeneous powder mixture;

(b) agglomerating said homogeneous powder mixture with a surfactant paste mixture in a high speed mixer/densifier to form detergent agglomerates, said surfactant paste mixture comprising from about 1% to about 80% by weight of a detersive surfactant system comprising $C_{10-20}$ linear allkylbenzene sulfonates, $C_{10-20}$ alkyl sulfates, $C_{10-18}$ alkyl ethoxy sulfates having from about 1 to about 7 ethoxy groups, alcohol ethoxylates, and polyethylene glycol;

(c) mixing said detergent agglomerates in a moderate speed mixer/densifier so as to build-up said detergent agglomerates; and (d) drying said detergent agglomerates so as to form said agglomerated detergent composition which has a density of at least about 650 g/l.

2. A process according to claim 1 in step (c) of said process further comprising the step of adding a coating agent.

3. A process according to claim 1 wherein said surfactant paste has a viscosity of from about 10,000 centipoises to about 100,000 centipoises.

4. A process according to claim 1 wherein said detergent agglomerates of said agglomerated detergent composition have a median particle size of from about 300 microns to about 600 microns.

5. A process for making an agglomerated detergent composition comprising the steps of:

(a) blending secondary (2,3) alkyl sulfate with a detergency builder to form a homogeneous powder mixture;

(b) agglomerating a liquid acid precursor of $C_{10}$–$C_{20}$ linear alkylbenzene sulfonate with said homogeneous powder mixture in a high speed mixer/densifier to form detergent agglomerates so as to form said agglomerated detergent composition which has a density of at least about 650 g/l.

6. A process according to claim 5 further comprising the step of mixing said detergent agglomerates in a moderate speed mixer/densifier so as build-up said detergent agglomerates.

7. A process according to claim 5 further comprising the step of cooling said detergent agglomerates.

8. A process according to claim 5 wherein said detergency builder is selected from the group consisting of alkali metal phosphates, ammonium phosphates, substituted ammonium phosphates, citric acid, aluminosilicates, carbonates, silicates, borates, polyhydroxy sulfonates, polyacetate carboxylates, polycarboxylates, zeolite and mixtures thereof.

9. A process according to claim 5 wherein said detergent agglomerates of said agglomerated detergent composition have a median particle size of from about 300 microns to about 600 microns.

10. A process according to claim 6 further including the step of adding a coating agent.

* * * * *